United States Patent [19]

Sajkovic

[11] 4,047,719

[45] Sept. 13, 1977

[54] BOARD GAME APPARATUS

[75] Inventor: Miriam D. Sajkovic, South Hadley, Mass.

[73] Assignee: The Raymond Lee Organization, Inc., New York, N.Y. ; a part interest

[21] Appl. No.: 689,485

[22] Filed: May 24, 1976

Related U.S. Application Data

[63] Continuation-in-part of Ser. No. 553,490, Feb. 27, 1975, abandoned, which is a continuation-in-part of Ser. No. 433,156, Jan. 14, 1974, abandoned.

[51] Int. Cl.[2] ..... A63F 3/00

[52] U.S. Cl. ..... 273/130 R; 273/136 R

[58] Field of Search ..... 273/130 R, 130 AC, 132, 273/131 AC, 135 R, 135 F, 135 AD, 136 R, 136 B, 136 E, 153 R, 153 S, 156, 157 R, 135 B, 131 E, 131 BA; 35/72, 73

[56] References Cited

U.S. PATENT DOCUMENTS

| | | | |
|---|---|---|---|
| 230,947 | 8/1880 | Kellogg | 273/132 |
| 287,352 | 10/1883 | Ward | 273/132 |
| 803,299 | 10/1905 | Morhous | 273/131 E |
| 895,114 | 8/1908 | Scrutchin | 273/157 R |
| 3,608,906 | 9/1971 | Odier | 273/136 E |
| 3,716,928 | 2/1973 | Meyer | 273/135 B |
| 3,791,649 | 2/1974 | Gold | 273/131 BA |
| D. 27,277 | 6/1897 | Velsor | 273/153 R |

*Primary Examiner*—Anton O. Oechsle
*Assistant Examiner*—Harry G. Strappello
*Attorney, Agent, or Firm*—Daniel Jay Tick

[57] ABSTRACT

A game board has an equilateral triangular configuration divided into a plurality of equal minor triangular areas formed by three groups of spaced parallel lines. Each group of lines is parallel to a corresponding side of the game board. Each of the minor triangles has three angle bisecting lines intersecting therewithin to form an inner pole. The apices of each minor triangle form three poles thereof representing *x*, *y* and *z* spatial coordinates and the inner pole represents the time coordinate whereby a viewer of the inner pole of a minor triangle sees a four coordinate system symbolizing the game apparatus. A plurality of groups of flat triangular plates are provided. Each group of plates comprises a plurality of colored plates for use by a player to identify a PLAYER SUBJECT and to design on the game board the PLAYER SUBJECT'S characteristics plus TIME.

4 Claims, 9 Drawing Figures

BOARD GAME APPARATUS

BACKGROUND OF THE INVENTION:

This is a Continuation-in-Part of application Ser. No. 553,490, filed Feb. 27, 1975, for Game Apparatus, now abandoned, which in turn, is a Continuation-in-Part of application Ser. No. 433,156, filed Jan. 14, 1974 for Game Apparatus, now abandoned.

The present invention relates to game apparatus.

Objects of the invention are to provide game apparatus for a game which provides interest, education, intellectual stimulation, awareness and intellectual enrichment, stimulates thought about basic tenets of life and engenders basic philosophical contemplation in the participants and observers.

BRIEF SUMMARY OF THE INVENTION

In accordance with the invention, game apparatus comprises a gameboard having an equilateral triangular configuration divided into a plurality of equal minor triangular areas formed by three groups of spaced parallel lines. Each group of lines are parallel to a corresponding side of the game board. Each of the minor triangles has three angle bisecting lines intersecting therewithin to form an inner pole. The apices of each minor triangle form three poles thereof representing *x*, *y* and *z* spatial coordinates and the inner pole represents the time coordinate whereby a viewer of the inner pole of a minor triangle sees a four coordinate system symbolizing the game apparatus.

The game board is formed into sixteen equal equilateral minor triangles and the peak minor triangle of the game board is marked TIME and the other minor triangles of the game board in descending order from left to right are respectively marked BIOTIC, PSYCHOLOGICAL, ANALYTICAL, MOTIONAL, PHYSICO-CHEMICAL, LINGUISTIC, HISTORICAL, ETHICAL, NUMERICAL, SPATIAL, ECONOMIC, SOCIOLOGICAL, AESTHETIC, JURIDICAL AND FAITH.

A pair of sub-minor triangles extend from opposite ends of the base side of the peak minor triangle of the game board. Each of the sub-minor triangles has base sides coplanar with that of the corresponding peak minor triangle. The sub-minor triangle on the left of the peak minor triangle is marked PLAYER SUBJECT and the sub-minor triangle on the right of the peak minor triangle is marked MY LIFE.

A plurality of groups of substantially flat triangular plates are provided. Each group of plates comprises a plurality of colored plates for use by a player to identify a PLAYER SUBJECT and to design on the game board the PLAYER SUBJECT'S characteristics plus TIME.

Each of the sub-minor triangles has three angle bisecting lines intersecting therewith to form an inner pole. The apices of each sub-minor triangle form three poles thereof representing x, y and z spatial coordinates and the inner pole represents the time coordinate.

BRIEF DESCRIPTION OF THE DRAWINGS

In order that the invention may be readily carried into effect, it will now be described with reference to the accompanying drawings, wherein:

FIG. 3*a* is a bow-tie.

FIG. 3*b* is a diamond.

FIG. 3*c* is a triangle pattern.

FIG. 3*d* is a halo.

FIG. 3*e* is a double halo.

FIG. 3*f* is a tetra halo.

FIG. 3*g* is a double triangle pattern.

DETAILED DESCRIPTION OF THE INVENTION

Figure 1:
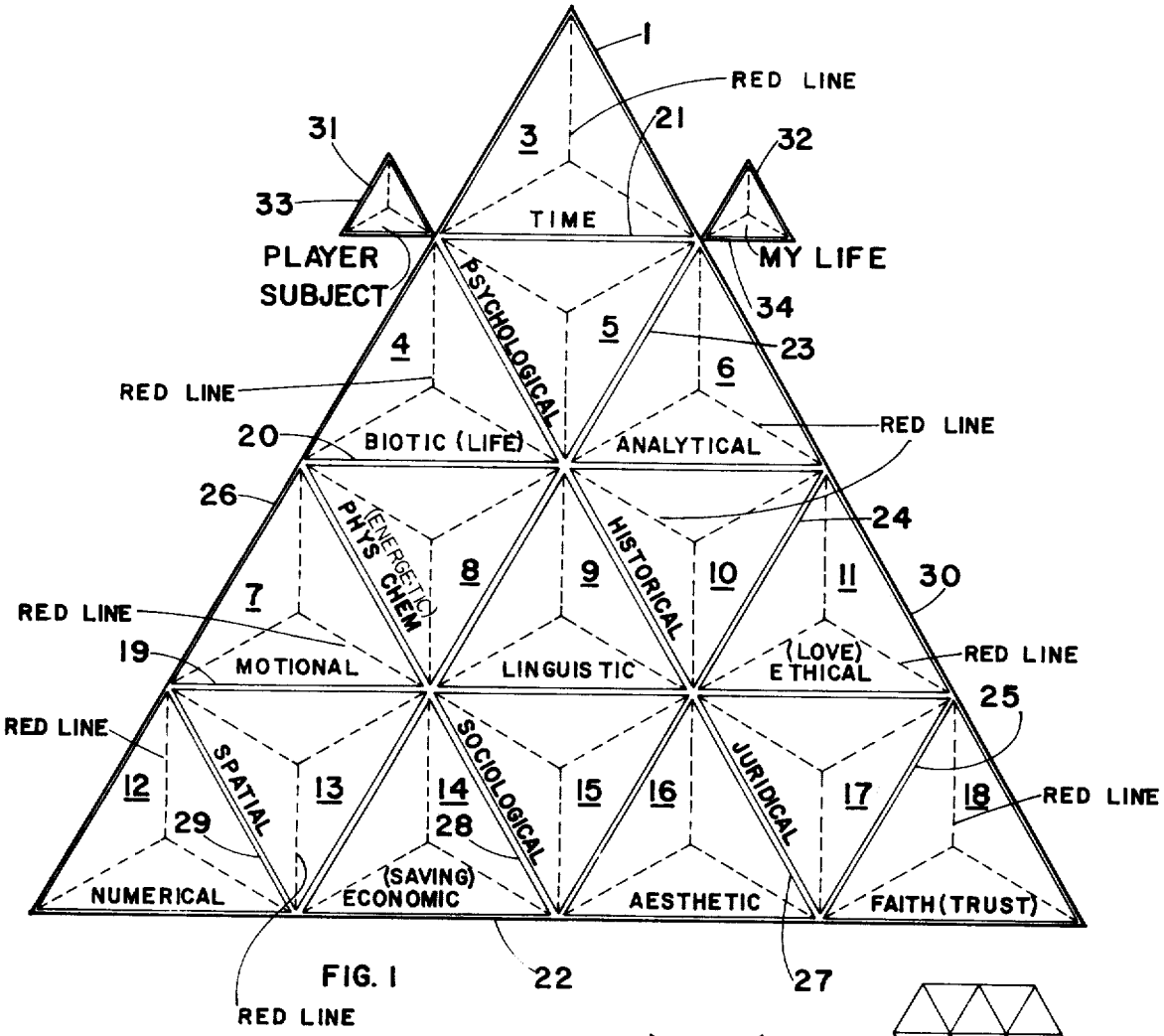
FIG. 1 is a schematic diagram of the board of the game apparatus of the invention.

The game apparatus of the invention, as illustrated in FIG. 1, comprises a triangular game board 1 which is divided into sixteen smaller equilateral triangles 3, 4, 5, 6, 7, 8, 9, 10, 11, 12, 13, 14, 15, 16, 17 and 18.

As shown in FIG. 1, the triangular game board 1 is formed into sixteen equilateral minor triangles 3 to 18 each having three inner, joined stereometric lines, indicated by broken lines, and joining at an inner imaginary point or pole.

Each of the areas 3 to 18 of the game board 1 is an equilateral triangle. The triangular areas are formed by three groups of spaced parallel lines. Each group of lines is parallel to a corresponding side of the game board 1. Thus, one group of lines 19, 20 and 21 comprises three lines parallel to a side 22 of the game board 1. A second group of lines 23, 24 and 25 comprises three lines parallel to a side 26 of the game board 1. A third group of lines 27, 28 and 29 comprises three lines parallel to a side 30 of the game board 1. The three groups of lines thus form 16 triangular areas 3 to 18.

The outer stereometric line of the triangular game board 1 and one of the parallel lines of each set, as well as the three inner stereometric lines of each of the 16 minor triangles, are red, to symbolize the TIME coordinate of the entire synthesis. The 15 minor triangles 4 to 18 are outlined in black or blue to symbolize each of the fields or name characteristics.

When a viewer looks at the poles for each field, he or she accounts for three measures. These measures are the three basic dimensions *x*, *y* and *z*, plus a fourth measure or coordinate, which is the inner pole and represents the fourth dimension, or TIME *t*. The illusory effect is tetrahedral and kinematic. The tetrahedral principle in optical illusion is seen when the viewer looks at the inner imaginary point or pole.

The illusion of the tetrahedral principle is illustrated by the polarities of the minor triangles. Each minor triangle has four poles, the inner one of which is the imaginary point or pole at which the three stereometric lines meet within each of the minor triangles. When the viewer looks at the imaginary poles, he or she has the illusion of dimension or extension, or of receding or extending away at one instant of time, and of approaching the viewing at another instant of time. The game board 1 is flat, but the illusion of the depth dimension is provided when the viewer looks at the inner pole of a minor triangle.

The outer stereometric lines of the game board 1 extending from the apex of the peak minor triangle 3, which is marked TIME, and the inner three lines of each of the remaining 15 minor triangles are red. The red lines symbolize the order and duration of TIME with each of the 15 minor triangles. The black or blue lines forming the 15 minor triangles symbolize their distinctive fields or subject meaning.

As the viewer looks at the entire game board, at one instant of time, he or she sees an interior cube set of figures, and at another instant of time, he or she sees a set of three stars. The optical illusion of motion, known as kinetic art form, is visible to any viewer. The game board symbolizes the tetrahedral principle in the four coordinate interrelated field *x, y, z* and *t*. The viewer looks at the four poles of each minor triangle, and not at the space. When the inner pole of each of the fifteen minor triangles 4 to 18 is viewed, the viewer has the optical illusion of change, motion or *t* coordinate.

The minor triangle 3 is the unifying idea, marked TIME, of the remaining fifteen minor triangles. The minor triangle 3 is red, and may actually be positioned anywhere among the remaining fifteen minor triangles 4 to 18. The minor triangles 4 to 18 in descending order from left to right are respectively marked BIOTIC, PSYCHOLOGICAL, ANALYTICAL, MOTIONAL, PHYSICO-CHEMICAL, LINGUISTIC, HISTORICAL, ETHICAL, NUMERICAL, SPATIAL, ECONOMIC, SOCIOLOGICAL, AESTHETIC, JURIDICAL and FAITH. The order of the fifteen minor triangles 4 to 18 is irreversible. That is, the fifteen minor triangles 4 to 18 are fixed in their relationship to each other.

The game apparatus of the invention further comprises a pair of sub-minor triangles. The sub-minor triangles 31 and 32 extend from opposite ends of the base side 21 of the peak minor triangle 3 of the game board 1. The sub-minor triangles 31 and 32 have base sides 33 and 34, respectively, coplanar with that 21 of the corresponding peak minor triangle 3.

The sub-minor triangle 31 is marked PLAYER SUBJECT. The sub-minor triangle 32 is marked MY LIFE.

Figure 2:
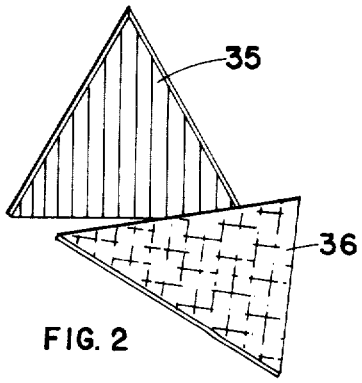
FIG. 2 is a schematic diagram of a pair of triangular plates of the game apparatus of the invention.

The game apparatus of the invention further comprises a plurality of groups of substantially flat triangular plates such as, for example, triangular plates 35 and 36 of FIG. 2. Each group of triangular plates comprises a plurality of plates of a single color different from the colors of the plates of the other groups of plates. The plates 35, 36, and so on, are in sets of four different colors. A single color set may represent a single PLAYER SUBJECT. A PLAYER SUBJECT represents any phenomenon, species, thing, event, and so on. The plates 35, 36, and so on, are dimensioned so that each fits on each of the 16 minor triangles 3 to 18 of the game board 1, and on the sub-minor triangles 31 and 32.

The game apparatus of the invention is called Tetraworld, which is a four-way word, meaning players kingdom or any set of things, acts, events, etc, and is a four-way meaning sentence:

Subjects/objects.
Verbs (action).
Place (spatial).
Time (the fourth dimension).

The first game, model set has two basic problems. These are the four kingdoms in the world, in our universe, which are man, the mineral-inorganic kingdom, the animal-zoological kingdom and the flora-organic kingdom, and the sciences, which are examples of the 15 meanings, with illustrations for each one. Thus, for example, the science of History relates to the Battle of Waterloo.

What do the players know about the world? They design how bright they are. The game played with the game apparatus of the invention is a new think-see building game and a game of integrity. The players operate by using their heads. They design to find out what is relevant. They challenge themselves and each other in relating nature, people, anything and everything they know in the world. The game is comprehensive.

The 15 minor triangles, excluding TIME, are to be filled in with the colored triangular plates while playing the game. These 15 minor triangles represent all the typical functional characteristics in the world. They are arranged in a simple to complex order, from NUMERICAL to TRUST or FAITH. TIME is not one of the 15 characteristics. TIME unifies the whole world of Tetraworld. TIME flows in and out and through all 15 characteristic meanings. TIME is the fourth dimension.

The several color triangular plates are for the players or subjects in the Tetraworld game. One color triangular plate is provided for each player or subject and another, different color triangular plate is provided for the player as object. The players are participating wonderers about the world. They position the characteristics of the player subjects. The players can play as many as four player subjects, since there is room for four in a triangle. After that, the triangular plates may be overlayed. They then form star relations.

Figure 3A:
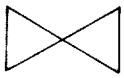
FIGS. 3*a*, 3*b*, 3*c*, 3*d*, 3*e*, 3*f* and 3*g* are schematic diagrams of patterns which may be formed on the board of the game played with the game apparatus of the invention.
Figure 3B:
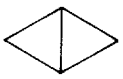
Figure 3C:
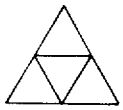
Figure 3D:
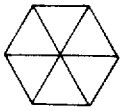
Figure 3E:
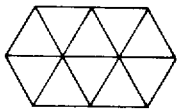
Figure 3F:
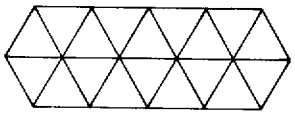
Figure 3G:
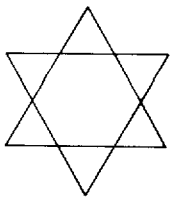

Several patterns may be formed in the game. These include a bow-tie, or single bond relationship, as shown in FIG. 3*a*, a diamond or double bond relationship, as shown in FIG. 3*b*, a triangle pattern or four way relationship bonding, as shown in FIG. 3*c*, a halo or hexagon, or six way relationship bonding, as shown in FIG. 3*d*, a double halo or synergy two systems in relationship, as shown in FIG. 3*e*, *a tetra halo or four-dimensional relationship systems, as shown in FIG. 3f*, and a double triangle pattern or overlay or overlay star relationship, on two levels, as shown in FIG. 3*g*.

The fifteen modalities, are in order from simplicity to complexity, and are in adjectival form to avoid confusing modal active function with concrete thing. The fifteen modalities have the following meanings.

NUMERICAL means the quantitative aspect of anything, anyone.

SPATIAL means the aspect of extension, geometric forms enclose, aspect of circumstance in place, location.

MOTIONAL means the function of flowing, moving.

PHYSICO-CHEMICAL (ENERGETIC) means the modality of the inorganic aspect, structures of elements, quanta, characteristic of "energy" proper.

BIOTIC means the characteristic of life function in organic, in sense aspect, in aspect of stimulus responsive.

PSYCHOLOGICAL means the feeling aspect like needful, desirous, curious, inquiring.

ANALYTICAL means the modal aspect of the intuitive, memorable, the naive or pre-logical irrational and the logical-rational ability to make distinction, for example, subject/object distinctions and relationships.

HISTORICAL means the cultural aspect of initiative agents or persons to construct institutional function, such as family, state, etc, characteristic aspect of tradition, aspect of present circumstance, situation characteristic function or self-determining function to control and direct information of culture.

LINGUISTIC means the modal aspects of meaning and direction through signification, such as languages, mathematical constructive ability, and symbolization ability, such as tokens, forms, etc.

SOCIOLOGICAL means the aspect of social intercourse, social formative ability which permits community and communication, utilizing prior modality of the linguistic, of the family, the sanctuary aspect of temple, church, the educative aspect of the school, etc.

ECONOMIC means the characteristic of saving related to scarcity of a good, resource, the distributive functional ability, also the serviceability.

AESTHETIC means the modal aspect of beauty, ability to order, harmonic function, the mythological active function, functional arts.

JURIDICAL means the functional aspect of justice, involves the law and rule ability, aspect of obedient function, recognition of awe aspect, the retributive and attributive aspects.

ETHICAL means the active function of love which activates in kindness, empathy, compassion, and divine love or agape.

FAITH or TRUST means the characteristic aspect of belief or certitude.

The TIME minor triangle 2 links the fifteen minor triangles 4 to 18 in order and duration. The 15 minor triangles 4 to 18 constitute the heart of the game of the invention, since they constitute its meaning. The PLAYER SUBJECT sub-minor triangle 31 indicates any subject to be designed with the TIME plus the fifteen characteristic means of the game board. The MY LIFE sub-minor triangle 32 is intended to indicate the designer or player playing the game.

The purpose of the game of the invention is to design meaningful interrelated structures of any phenomenon or problem the designer or player wishes. The result is a visible demonstration, with the color sets of the plates 35, 36, and so on, of individual, comparative and complex structures, each of which has meaning. Each color of the plates 35, 36, and so on, represents a PLAYER SUBJECT. The plates 35, 36, and so on, are dimensioned to permit four different subjects on any of the minor triangles 4 to 18, and four on the TIME minor triangle 3.

The directions for playing the game of the invention are as follows. The players look at the board and familiarize themselves with the name meanings of the 15 characteristics. A player plays himself first. He asks, "Do I possess whatever the characteristic function is?" The player then places a color triangular plate on PLAYER thereby turning himself into a Player and places a color triangular plate on TIME, since we live in a TIME world.

The player then proceeds to find the characteristics for human beings, themselves. The players try to position the triangular plates so that they touch relate. When the player finishes, he compares his findings with an Answer Sheet No. 1. Before he looks at the answer, he asks himself which characteristic is the lead qualifying one for man, for us. A lead characteristic is the one function which is the speciality to be actualized, the destiny to be realized.

The second player selects another color triangular plate for ANIMAL or zoological kingdom. He places a color triangular plate on PLAYER and on TIME, as he did for himself. He then places color triangular plates on the characteristic functions which he thinks belongs to the subject animal, as subject, intrinsically.

The second player tries to find the lead characteristic. It will be the one in which the player is destined to actualize in the world. He marks it with an L on the plate if he finds one. He compares his findings with an Answer Sheet No. 2.

A third player then takes another color plate for the vegetable or flora kingdom, like tomatoes. He places a color plate on PLAYER and another on TIME for the flora life kingdom. The player then finds the intrinsic characteristics for this kingdom on the board. He places plates on the functions he finds. When he is finished, he tries to determine which one is the lead characteristic, as did the second player. If found, it is marked. The findings are compared with an Answer Sheet No. 3.

A fourth player takes a fourth color triangular plate for the mineral inorganic kingdom, like a rock or atom. He places a color plate on PLAYER and another on TIME. He then tries to find the characteristics for mineral world as he did for the others. The player also tries to find the lead qualifying characteristic for this kingdom. He marks it with an L if he finds one. He then compares his answers with an Answer Sheet No. 4.

All four kingdoms have then been played. The players then place their four different color plates back on the board, starting with the HUMAN or MAN first. A special four dimensional visual pattern emerges, which is in systematically related, synergetic operation. These are the four systems in motion. This is compared with the Answer Sheet No. 5.

The players then study their first completed problem. Only five kingdoms have lead qualifying characteristics. These are ANIMAL, with the lead in PSYCHOLOGICAL, VEGETABLE, with the lead in BIOTIC, MINERAL with the lead in PHYSICO-CHEMICAL or ENERGETIC. MAN has no lead qualification, since each and all the functions are aspects equally for human beings or man.

A complete triangle is formed on TIME as well as with the four PLAYERS. Four triangles are filled on the characteristics. If closely observed, one sees the four-dimensional, actually moving, synergetic systems operating in our universe symbolically. Man participates. Humans are indeed needed to operate with the world, to help to make it work. This is presented by the game apparatus of the invention in visual conceptual logic for the first time. This new logic is not syllogistic, but correlative logic.

It is also observed that MAN does not have a lead qualifying special function hereinbefore mentioned. Man is really a generalist. He needs to choose to become a comprehensive thinker and cooperative active doer in the world.

If one observes closely, one sees also that man's total functions form in a bow-tie relationship pattern a larger moving pattern which is three intersecting stars with a synergetic moving constellation pattern.

Once the four kingdoms systems have been completed, the players may proceed to another problem involving the sciences and illustrations.

A viewer of the game board 1 sees what appears to be a three-dimensional object whereas the game board is essentially two-dimensional. The inner pole of each minor triangle on the game board makes the two-dimensional minor triangle appear to a viewer to be a three-dimensional tetrahedron. Furthermore, the viewer visualizes the fourth dimension, which is time, when the object is moving in time with respect to a frame of reference which the eye must also be able to see during the same instants in time. When the object is said to move, it is understood to mean that it changes its spatial coordinate position with respect to the time coordinate.

While the invention has been described by means of a specific example and in a specific embodiment, I do not wish to be limited thereto, for obvious modifications will occur to those skilled in the art without departing from the spirit and scope of the invention.

I claim:

1. Game apparatus, comprising a game board having an equilateral triangular configuration divided into sixteen equal equilateral minor triangular areas formed by three groups of spaced parallel lines, each group of lines being parallel to a corresponding side of the game board, each of the minor triangles having three angle bisecting lines intersecting therewithin to form an inner pole, the apices of each minor triangle forming three poles thereof representing *x*, *y* and *z* spatial coordinates and the inner pole representing the time coordinate whereby a viewer of the inner pole of a minor triangle sees a four coordinate system symbolizing the game apparatus, said game board having a peak minor triangle marked TIME, and the other minor triangles of the game board in descending order from left to right being respectively marked BIOTIC, PSYCHOLOGICAL, ANALYTICAL, MOTIONAL, PHYSICOCHEMICAL, LINGUISTIC, HISTORICAL, ETHICAL, NUMERICAL, SPATIAL, ECONOMIC, SOCIOLOGICAL, AESTHETIC, JURIDICAL and FAITH.

2. Game apparatus as claimed in claim 1, further comprising a pair of sub-minor triangles extending from opposite ends of the base side of the peak minor triangle of the game board, each of the sub-minor triangles having base sides coplanar with that of the corresponding peak minor triangle, the sub-minor triangle on the left of the peak minor triangle being marked PLAYER SUBJECT and the sub-minor triangle on the right of the peak minor triangle being marked MY LIFE.

3. Game apparatus as claimed in claim 2, further comprising a plurality of groups of substantially flat triangular plates, each group of plates comprising a plurality of colored plates for use by a player to identify a PLAYER SUBJECT and to design on the game board the PLAYER SUBJECT'S characteristics plus TIME.

4. Game apparatus as claimed in claim 3, wherein each of the sub-minor triangles has three angle bisecting lines intersecting therewith to form an inner pole, the apices of each sub-minor triangle forming three poles thereof representing *x*, *y* and *z* spatial coordinates and the inner pole representing the time coordinate.

* * * * *